US007062820B1

(12) United States Patent
Oestreich et al.

(10) Patent No.: US 7,062,820 B1
(45) Date of Patent: Jun. 20, 2006

(54) HAND REMOVABLE TOTE BOX LID RETAINER

(75) Inventors: Robert L. Oestreich, Shalimar, FL (US); Thomas R. Davidson, Philadelphia, PA (US)

(73) Assignee: Americas Merchandise Enterprise, Inc., Shalimar, FL (US)

( * ) Notice: Subject to any disclaimer, the term of this patent is extended or adjusted under 35 U.S.C. 154(b) by 17 days.

(21) Appl. No.: 10/861,322

(22) Filed: Jun. 4, 2004

Related U.S. Application Data

(60) Provisional application No. 60/542,652, filed on Feb. 6, 2004.

(51) Int. Cl.
*B65D 63/00* (2006.01)

(52) U.S. Cl. ..... 24/16 PB; 24/17 AP

(58) Field of Classification Search ..... 24/16 PB, 24/17 AP
See application file for complete search history.

(56) References Cited

U.S. PATENT DOCUMENTS

| | | | | | |
|---|---|---|---|---|---|
| 3,302,258 | A | * | 2/1967 | Meyer | 24/16 PB |
| 3,360,162 | A | | 12/1967 | Miles | 220/97 |
| 3,379,341 | A | | 4/1968 | Miles | 220/97 |
| 3,537,146 | A | | 11/1970 | Caveny | 24/16 |
| 3,600,027 | A | | 8/1971 | Noland | 24/16 PB |
| 3,660,869 | A | | 5/1972 | Caveny et al. | 24/16 PB |
| 3,712,655 | A | | 1/1973 | Fuehrer | 292/321 |
| 3,779,374 | A | | 12/1973 | Bockenstette | 206/56 DF |
| 3,965,538 | A | | 6/1976 | Caveney et al. | 24/16 PB |
| 4,001,919 | A | | 1/1977 | Moberg et al. | 24/16 PB |
| 4,046,312 | A | | 9/1977 | Krizin | 229/45 R |
| 4,128,220 | A | | 12/1978 | McNeel | 248/60 |
| 4,312,614 | A | | 1/1982 | Palmer et al. | 411/44 |
| 4,441,233 | A | | 4/1984 | Swift | 24/16 PB |
| 4,454,632 | A | | 6/1984 | Nix et al. | 24/16 PB |
| 4,489,465 | A | | 12/1984 | Lemkin | 24/289 |
| 4,501,049 | A | * | 2/1985 | Adamson | 24/17 AP |
| 4,506,415 | A | | 3/1985 | Swift | 24/16 PB |
| 4,697,833 | A | | 10/1987 | Swift | 292/318 |
| 4,752,054 | A | * | 6/1988 | Jonsson | 24/16 PB |
| 5,193,250 | A | | 3/1993 | Caveny | 24/16 PB |
| 5,197,164 | A | | 3/1993 | Meier | 24/16 PB |
| 5,337,503 | A | | 8/1994 | Goby | 24/16 PB |
| 5,524,945 | A | * | 6/1996 | Georgopoulos et al. | 24/16 PB |
| 5,651,652 | A | | 7/1997 | Williams et al. | 411/508 |
| 5,774,974 | A | | 7/1998 | Dunfield et al. | 24/16 PB |
| 5,881,435 | A | | 3/1999 | Jermyn, Jr. | 24/16 PB |
| 5,901,416 | A | | 5/1999 | Mears | 24/16 PB |
| 6,105,210 | A | * | 8/2000 | Benoit | 24/16 PB |
| 6,105,908 | A | | 8/2000 | Kraus | 248/74.3 |
| 6,185,791 | B1 | | 2/2001 | Khokhar | 24/16 PB |

(Continued)

*Primary Examiner*—Robert J. Sandy
(74) *Attorney, Agent, or Firm*—Mark Douma

(57) ABSTRACT

A tote box retainer made from a cable tie having a tear tab that is attached to the main strap of the tie on one side near a strap-teeth, engaging-pawl enclosure and extending alongside the enclosure in a direction inline with the strap, there being at least one channel in the strap between the pawl enclosure and edge of the tear tab closest to the enclosure producing a web that connects the strap and enclosure wherein a centerline in the channel does not rotate through more than about 60° and the web does not extend completely to the edge of the strap opposite the tear tab leaving a thick portion in the strap for reinforcement. Other variations replace the thick portion with a second tear tab reinforcing an extension of the web or relocate the web away from the pawl enclosure.

11 Claims, 4 Drawing Sheets

U.S. PATENT DOCUMENTS 6,347,434 B1 2/2002 Newman ..... 24/16 PB
6,449,808 B1 9/2002 Zappa et al. ..... 24/16 PB
6,536,082 B1 3/2003 Berrocal et al. ..... 24/16 PB
6,698,068 B1 3/2004 Autterson ..... 24/16 R
6,828,509 B1 * 12/2004 Ito et al. ..... 24/16 PB
2003/0229972 A1 12/2003 Welch ..... 24/16 PB

* cited by examiner

HAND REMOVABLE TOTE BOX LID RETAINER

CROSS REFERENCE TO RELATED APPLICATIONS

This application claims priority from provisional application Ser. No. 60/542,652, filed on Feb. 6, 2004, incorporated herein by reference.

BACKGROUND

1. Technical Field

This invention is in the field of package ties in the form of plastic bands. U.S. patent main class 24, subclass 16PB contains a large number of these.

2. Background

An example of an early patent in subclass 16PB is U.S. Pat. No. 3,965,538 for an Integral Cable Tie, issued Jun. 29, 1976 to Cavenay et al. and assigned to Panduit Corp., incorporated herein by reference. This is for a cable tie that is by now well known in design. It is a one piece flat plastic strap having a rectangular enclosure ("frame" in the patent) at one end with a tapered tip at the other. The body of the strap between the enclosure and tip has a plurality of equally spaced ridges or teeth on one side. The enclosure has an entrance (throat) for the tip on the same side of the strap as the teeth and an exit on the opposite side. Within the enclosure is a hinged pawl, also having several teeth, that engages the strap teeth after insertion of the strap. The strap teeth and pawl are designed to make insertion of the strap through the enclosure easy and pulling the strap out in reverse difficult. Thus, when wrapped around a bundle of electrical cables, they may be secured together or to, e.g., a bulkhead in an aircraft, etc. Normally, the tie is undisturbed for the life of the equipment. If it has to be removed, it is cut with pliers. Because the strap, enclosure, and internally hinged pawl are all designed as a single piece of injection molded plastic and installation is generally fast, the cost for each tie is small compared to other solutions such as lacing cords. As cable ties go, this design produced an apparently very superior product. The one possible drawback is that it is a bit complex and requires care in mold making and injection molding the parts.

It may be of interest that this patent was initially invalidated by a U.S. district court as being obvious in view of the prior art in cable ties. This decision was appealed up to the U.S. Supreme Court which sent it back to the Court of Appeals for the Federal Circuit for reconsideration. The Court of Appeals followed the law as indicated by the Supreme Court, but still decided that the invention in this patent (and two others) was not obvious and therefore the patent was valid. The court seemed to be impressed by the low ratio of insertion to removal force and the outstanding commercial success. (The decision is published at 810 F.2d 1561 or 1 USPQ2d 1594.)

As of this writing, main patent class 24, subclass 16PB contains almost 670 patents, including cross references, going back to U.S. Pat. No. 3,930,287 issued on Jan. 1, 1976. A fair number are titled "Cable Tie" or similar. There are a lesser number titled "Security Seal" or similar. An example of a security seal is U.S. Pat. No. 4,501,049 for a Disposable One-Piece Security Sealing Device, issued Feb. 26, 1985 to Adamson and assigned to Envopak Limited (Kent, England). It is "primarily intended to surround the neck of bag [a mail sack appears to be illustrated] or like package." This is like the patent described above, but has an extension of the main strap that goes around the pawl enclosure and spreads out into a flat extension about twice the width of the strap. Additionally, a "line of weakness" separates the extension and the enclosure and extends around the enclosure and makes its way along a serpentine path to the other side of the strap. Pulling the extension causes the strap to separate and release from the bag. Additional features include molded-in spikes to hold the strap against a cloth, a molded wire loop for affixing a label, and an anti-tampering design for the teeth, enclosure and pawl.

While the above referenced patents disclose designs that are suitable for their primarily intended purpose, there is another use for plastic bands. This is in that part of the distribution and supply industry that uses tote boxes. These are used in distribution networks that supply retail outlets with dry goods that are diverse as to shape and quantity. For example, restocking a drug store requires a mixture of products, most of which are in an assortment of small packages. There are a number of different designs for tote boxes that generally include a rectangular box about two cubic feet in size with a lid or cover. Typically, there are grooves that keep the lid oriented and may have retaining functions. Quite often there are matching holes in the lid and boxes arranged near an edge and lip, respectively, so that cable ties can pass through the holes and retain the lid to the box. An early example is U.S. Pat. No. 3,360,162 for a Tote Box, issued Dec. 26, 1967 to Miles, wherein it is claimed that, to discourage pilferage, a sealing element may be passed through aligned slots in the lid and a flange extending from the top of the box.

The sealing elements in this patent have a dual purpose of providing a modicum of security but, primarily, keeping the lid on the box from warehouse to retail outlet. There are some security seals for tote boxes that do provide security, but do not act to hold the lid tightly to the box. Currently, the industry standard is to use the same ties that are used for bundling electrical cables. On arrival at the retail outlet, single sided knives, wire cutters, or hefty scissors are used to cut the cable tie to open the lid. Use of a sharp tool produces a safety issue, can damage the tote box, and keeping track of it slows down the operation. An improved retaining means is required that could be manually separated without tools, yet strong enough to retain the lid to the box during transit. Currently, the industry prefers to use a cable tie once rather than return retainers back with the tote boxes. (Because many cables ties are all plastic, they can be recycled.) The one-time use and large volume require that any improved tote box retainer cost no more than currently available cable ties.

This tote box application differs from sealing the neck of a bag or sack. Usually, if a security seal is pulled tightly around the neck of a full sack, it will be well fixed with respect to the sack. Thus, the need in Adamson's design to pull an extension at right angles to the strap, then switch direction and follow a serpentine path would be feasible. Tote box retaining holes, however, are usually larger than the straps of the ties used. Even when a retaining strap is tight enough so that the lid cannot come off, which is generally all that is demanded, the strap may rotate around itself and rock back and forth. This makes a tear-off extension that needs pulling in multiple directions undesirable. Some tote boxes are designed so that any straps remain inside the outer box dimension to prevent damage to the retainer or personnel. This can put the retainer in a confined space so that it is awkward to remove.

Even though tote boxes and cable ties are at least about 30 years old, there is still an unfulfilled need in the market, for a tote box retainer strap that is simple and inexpensive to make, yet easy to remove without tools while strong enough to retain the lid on the box.

SUMMARY

The aforementioned needs of the market have been fulfilled by tote box retainer strap design that, while appearing to be simple and in expensive to make, is easy to separate without tools, but strong enough to retain a lid on a tote box.

In particular, the tote box retainer is made from a cable tie having a pull tab that is attached to the main strap of the tie on one side near a strap-teeth, engaging-pawl enclosure and extending alongside the enclosure in a direction inline with the strap, there being at least one channel in the strap between the pawl enclosure and edge of the pull tab closest to the enclosure producing a web that connects the strap and enclosure wherein a centerline in the channel does not rotate through more than about 60° and the channel does not extend completely to the edge of the strap opposite the pull tab.

In the most favored design, the pull tab extends from the side of the strap and alongside the pawl enclosure directly away from the strap. The web extends from a thick portion of the strap on the side opposite the pull tab to the pull tab and between the pawl enclosure and pull tab. In particular, the thick portion extends interior of the edge sufficiently to produce a strap that is about as strong, or stronger than, the force necessary to pull an inserted strap back out of the pawl enclosure. The pull tab has ribs on its top and bottom to provide friction for grasping with an opposed forefinger and thumb.

In general, the strap is characterized by having a separation structure that can be a relatively thin web extending across the strap and terminated with web reinforcing sections, at least one of which is simply an extension of the web beyond the edge of the strap between the strap and a tab that can be pulled to separate the strap. The web extension can be a short segment between the enclosure and pull tab. It can also be a longer section along the edge of the strap separating the strap from the pull tab. Both web reinforcing sections can be comprised of web sections along opposite edges of the straps with pull tabs on either side, the two web extensions being connected by a V-shaped channel.

In other versions, the extension could be at different orientations with respect to the strap. The strap could have stops that protrude enough to limit the distance the strap may be inserted into the pawl housing to limit how tightly the strap can be pulled.

BRIEF DESCRIPTION OF THE DRAWINGS

The invention will now be described in more detail with reference to preferred forms of the inventions, given only by way of example, with reference to the accompanying drawings, in which.

DETAILED DESCRIPTION

Figure 1A:
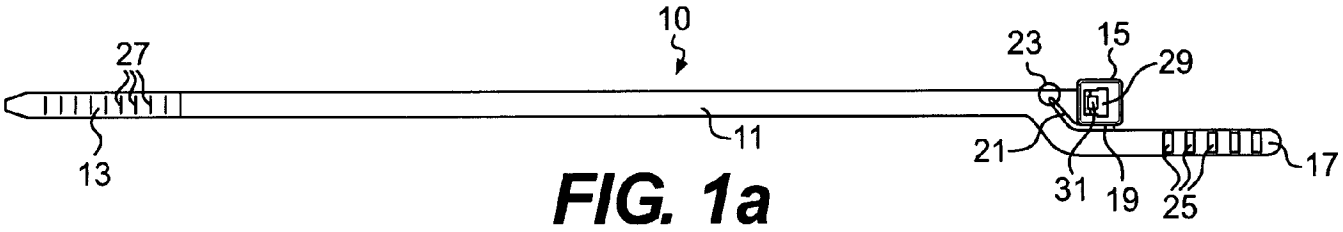
FIG. 1*a* shows a top view of one version of the invention comprising a cable tie having a strap and a tear tab.

FIG. 1*a* is top view of one version of the tote box retainer 10 according to this invention. A strap member 11 is terminated on one end with a tapered tip 13 and on the other end with rectangular enclosure 15 that is in line with the strap and a tab 17 that is a continuation of the strap to one side around the enclosure. A top side channel 19 produces a reduced material thickness web 21 between the enclosure 15 and strap 11 and tab 17. The channel does not extend across the entire width of the strap 11, but stops short leaving a thick region 23. Other features include top side raised rib or ribs 25 on the tab and similar ones 27 on the tip. (The ribs 27 are often not necessary, but the ribs 25 are much more useful.) The enclosure has an exit hole 29 within which is visible a pawl 31 whose significance will be explained.

Figure 1B:
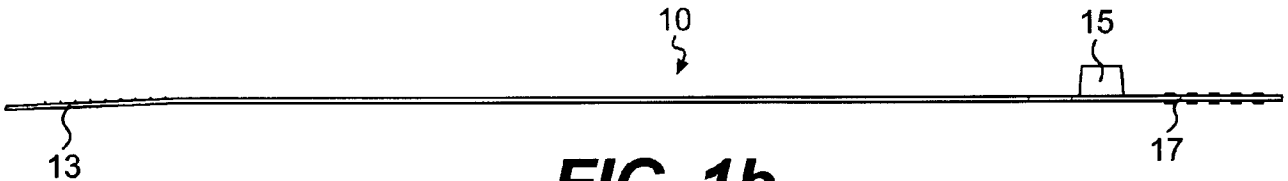
FIG. 1*b* shows a side elevation view of the version in FIG. 1*a;*

FIG. 1*b* is a side elevation view of the version shown in FIG. 1*a* illustrating the size of the enclosure 15 in relation to the strap 11. In this version, the tab 17 is coplanar with the strap 11, but the tip 13 is slightly angled to facilitate insertion into the enclosure 15. Other features are too difficult to discern on this scale drawing, but are not needed for understanding the invention.

Figure 1C:
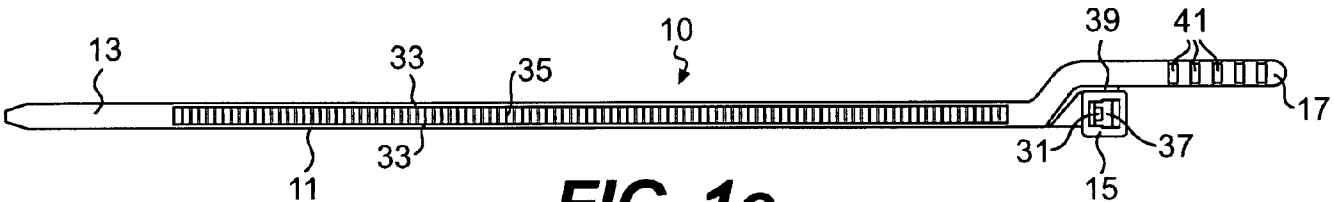
FIG. 1*c* shows a bottom view of the version in FIGS. 1*a* and 1*b;*

FIG. 1*c* is a bottom view of the version shown in FIGS. 1*a* and 1*b*. The bottom of the strap 11 has side rails 33 between which are serrations or teeth 35 more or less equally spaced along a substantial portion of the strap 11. A bottom side channel 39 separates the enclosure 15 from the strap 11. This channel is opposite the top side channel 19. Channel 39 continues across the entire width of the strap 11. The enclosure 15 has a slightly tapered entrance hole 37 within which pawl 31 is visible. Also, the tab 17 has bottom side raised rib or ribs 41. The top and bottom rib or ribs 25 and 41 are very useful for providing a less slippery finger gripping surface for pulling on the tab 17.

To use the illustrated tote box retainer, the strap 11 is inserted through matching holes in the lid and box. The tip 13 is bent around and inserted through the enclosure entrance hole 37 forming a circle with the strap teeth 35 on the inside. The tip and strap are pulled until the retainer is snug. Typically, two or more retainers are used per tote box. When the tote box arrives at its destination, the retainer can be removed by pulling on the tab 17. Once the channel begins to tear at its open end, it is easy to continue tearing through the web 21 and the thick region 23.

It is important that forces on tote box lids do not pull the retainer apart. Thus the web 21 left between the two channels 19 and 39 cannot be too thin. The reason for the thick region 23 is that this is where the maximum tensile stresses occur. It is on the outside diameter of a circular band formed by an installed retainer. On the opposite side of the strap 11, once the web 21 extends beyond the edge alongside the enclosure, the stresses on the web decrease going along the channels 19 and 39 toward the open ends. In this variation, much less stress should be transmitted to the web at the end point than in the section traversing the strap. Thus, the web 21 between the enclosure 15 and tab 17 can be wider and/or thinner to facilitate the start of tearing with the tab 17. By the time the thick region 23 is encountered, the freed tab length provides enough extra leverage to tear through it.

Working Examples:

Working examples were made with the following dimensions: overall length (10)—6.45", enclosure (15)—about 0.20"×0.25", strap (11) width—0.15", strap (11) thickness—0.06", channel web (21) thickness—0.006", and rib (25 & 41) height—about 0.01". The number of teeth (35) was 24 per inch with a depth of about 0.02".

Examples were made from nylon 6/6 and polypropylene using well know injection-molded plastic techniques. Samples were tested to Society of Automotive Engineers test standard AS23190 using the method in FIG. 1, "Tensile test fixture for strap components." In this, the strap is tightened around a ⅜ inch-diameter, split mandrel whose two halves are separated until the strap breaks. Tests showed a minimum tensile strength of 50 lbs. for the nylon and 30 lbs. for the polypropylene. About 99% of the time, the strap pulled out of the pawl enclosure rather than breaking at the channel area.

No claim is made to the pawl and tooth design; it could probably be optimized further. The Caveney patent referred to above shows how to use a pawl with more than one tooth to engage more than one tooth on the strap. The Caveney design could be adapted to this cable tie for added pull-through strength.

Using a tensilometer, tests were conducted to determine the tensile force on the tab 17 that is needed to separate the strap 11. An attempt was made to simulate the motion that a human hand would make in producing the separation. This resulted in peak readings of about 8 lbs. for nylon and 6 lbs. for polypropylene. Subjectively, it was quite easy to separate the strap, if one maintained a continuous motion.

Figure 2A:
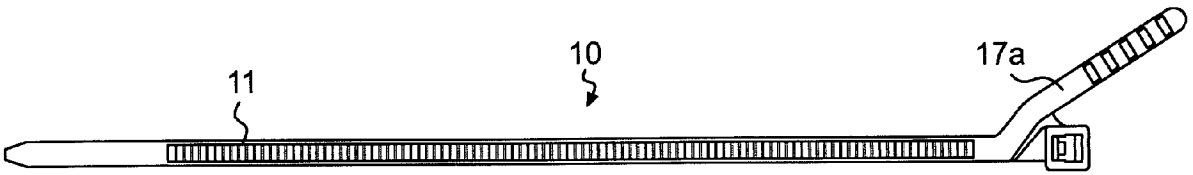
FIG. 2*a* shows a bottom view of another version of the invention having a tear tab at a 45° angle in the plane of the strap.

Other Variations:

As illustrated in FIGS. 2*a*–7*b*, a number of variations are possible. In FIG. 2*a*, the tear tab 17*a* is at a 45° angle in the plane of the strap 11. In this variation, the web does not extend quite so far around the enclosure as in FIG. 1. However, because the web extends beyond the edge of the strap, tensile forces are distributed along enough web material to resist tearing on that edge when the strap is under tensile stress.

Figure 2B:
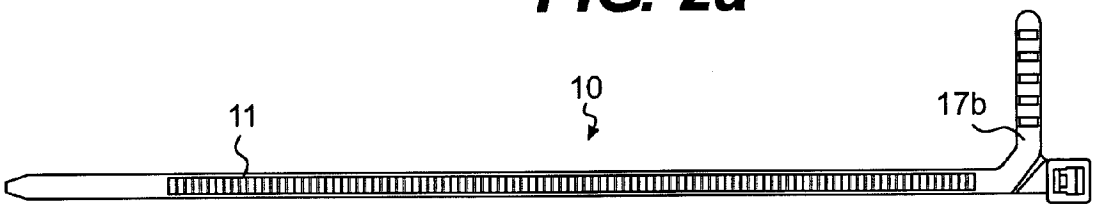
FIG. 2*b* shows a bottom view of still another version of the invention wherein the tear tab is at a 90° angle in the plane of the strap.

In FIG. 2*b*, the tear tab 17*b* is at a 90° angle in the plane of the strap 11. FIG. 2*b* is an extreme version of FIG. 2*a*. The web extends beyond the edge of the strap, but not as far and to produce the same tensile strength the web would have to be made thicker than the version shown in FIG. 2*a* and, especially, FIGS. 1*a*–1*c*.

Figure 3A:
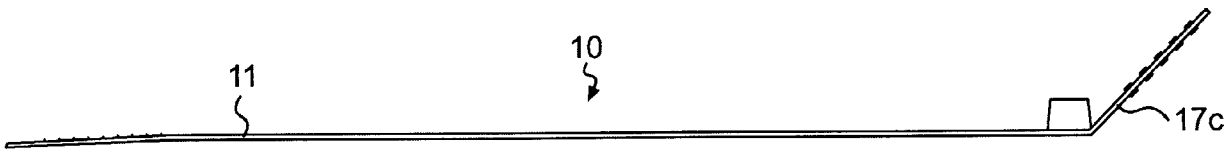
FIG. 3*a* shows a side view of another version wherein the tear tab is directed upwardly at 45°.
Figure 3B:
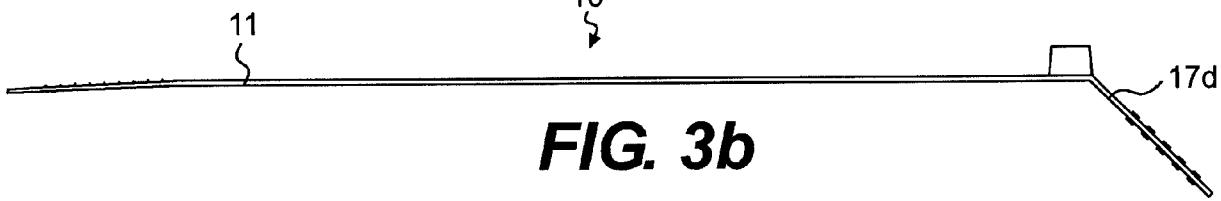
FIG. 3*b* shows a side view of another version wherein the tear tab is directed downwardly at 45°.

In FIG. 3*a*, the tear tab 17*c* is at a positive 45° angle to the plane of the strap 11. In FIG. 3*b*, the tear tab 17*d* is at a negative 45° angle to the plane of the strap 11. Although not illustrated, these would have the same web design as in FIGS. 1*a*–1*c*.

Figure 4A:
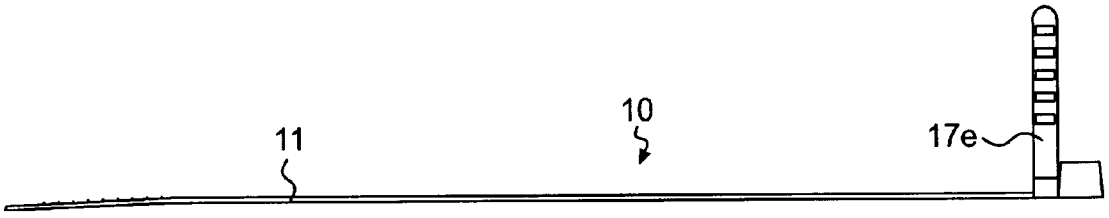
FIG. 4*a* shows a side view of another version wherein the plane of the tear tab is rotated 90° and its axis is directed upwardly.
Figure 4B:
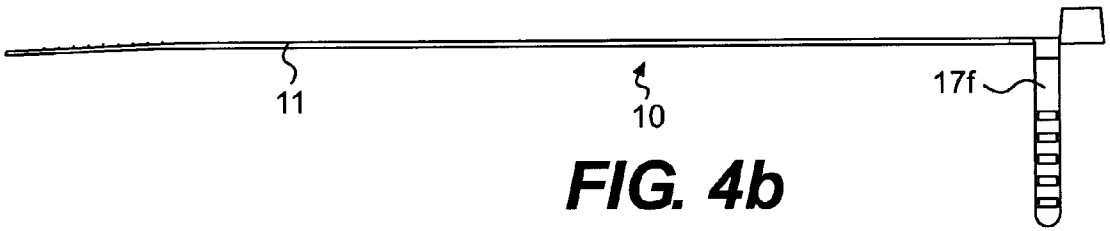
FIG. 4*b* shows a side view of another version wherein the plane of the tear tab is rotated 90° and its axis is directed downwardly.

In FIG. 4*a*, the tear tab 17*e* is rotated 90° and its axis is directed to the top of the tie 10. In FIG. 4*b*, the tear tab 17*f* is rotated 90° and its axis is directed to the bottom of the tie 10. In FIGS. 4*a* & 4*b*, the web is not illustrated. However, as shown, the web could only go across the strap 11 from one edge to the other without any web extensions past an edge. Even if the web goes at an angle, to be strong enough, this would require a web so thick, approaching the thickness of the strap itself, that it would be relatively difficult to tear by hand by pulling on the tear tabs 17*e* and 17*f*.

Figure 5:
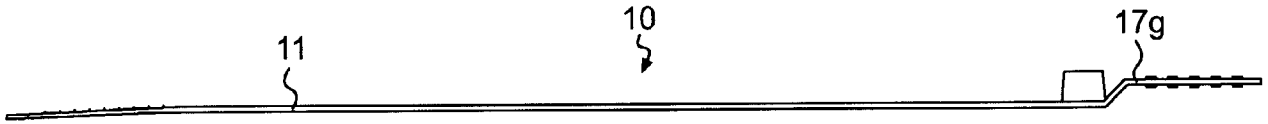
FIG. 5 shows a side view of another version of the invention wherein the tear tab plane is offset from the plane of the strap.

In FIG. 5, the tear tab 17*g* is offset from the plane of the strap 11. Here, the web design would be the same as that illustrated in FIGS. 1*a*–1*c*.

Of course, the angles in FIGS. 2*a*–5 are not meant to be exact but are merely additional examples of the invention. Moreover, the invention encompasses various combinations of rotations, directions, and offsets. Unfortunately, these designs are more difficult to manufacture using injection molded plastics than the design in FIGS. 1*a*–1*c*.

Figure 6:
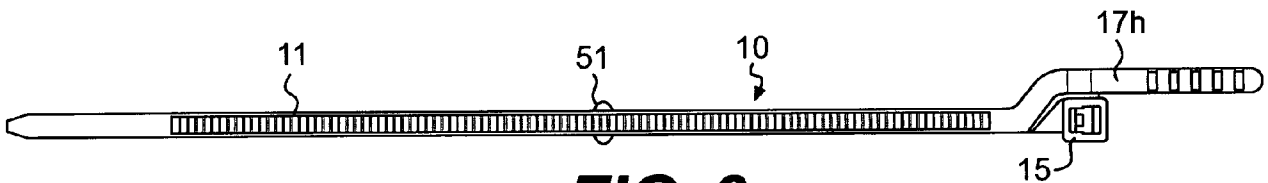
FIG. 6 shows a bottom view of the version illustrated in FIG. 1*a* having a stop.

FIG. 6 shows a top view of the version in FIG. 1*a* having strap stops in the form of ears 51 on either side of the strap 11. The purpose is to limit the amount that the strap 11 can be pulled through the housing 15. This will prevent the strap from being over-tightened. If the strap is too tight, it may break when subjected to a quick, sharp force, such as colliding with another tote box on a high speed warehouse conveyor, or if dropped by a handler. This is the situation discussed in the BACKGROUND section where a purposely loose cable tie requires a less complex separation motion than has been available until this invention.

In the version illustrated in FIG. 6, the teeth between the stops 51 and enclosure 15 are not used and could be replaced with a solid section. As an alternative to the stops 51, the strap could have a thick block in that location to prevent the strap 11 from entering the enclosure.

Figure 7A:
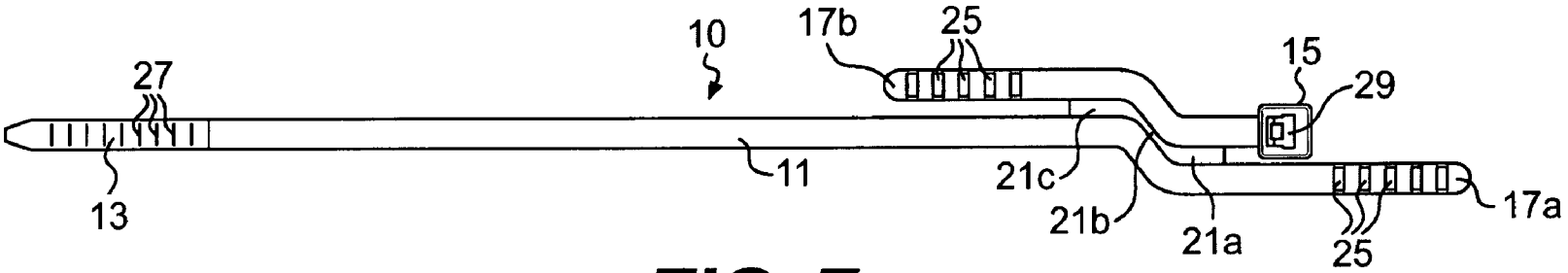
FIG. 7*a* shows a top view of another version of the invention having a two tear tabs directed oppositely.

Instead of reinforcing the web 21 with a thick section 23, the same reinforcing approach provided by extending the web past and along the edge of the strap 11 inside a tear tab could be used with a second tear tab. FIG. 7*a* illustrates a cable tie 10 with a web having a first section 21*a* inline with the strap 11, a section 21*b* traversing the strap, and a second inline section 21*c* on the opposite side of the strap 11 from section 21*a* and going in the opposite direction. Pull tabs 17*a* and 17*b* distribute tensile forces along the web extensions 21*a* and 21*c*, but allow hand separation by pulling in either direction.

This version illustrates that it is not essential for the web 21 to connect to the enclosure 15. The disadvantage is that less of the strap is available for insertion through the enclosure 15. It may be advisable to provide a stop as in FIG. 6 to prevent accidentally pushing on tab 17*b* and separating the web at the end of section 21*c*. Pull tab 17*b* could be converted to provide reinforcement only by restricting its length to the length of section 21*c* and making it narrower, but the thick section 23 would suffice just as well in that case.

Figure 7B:
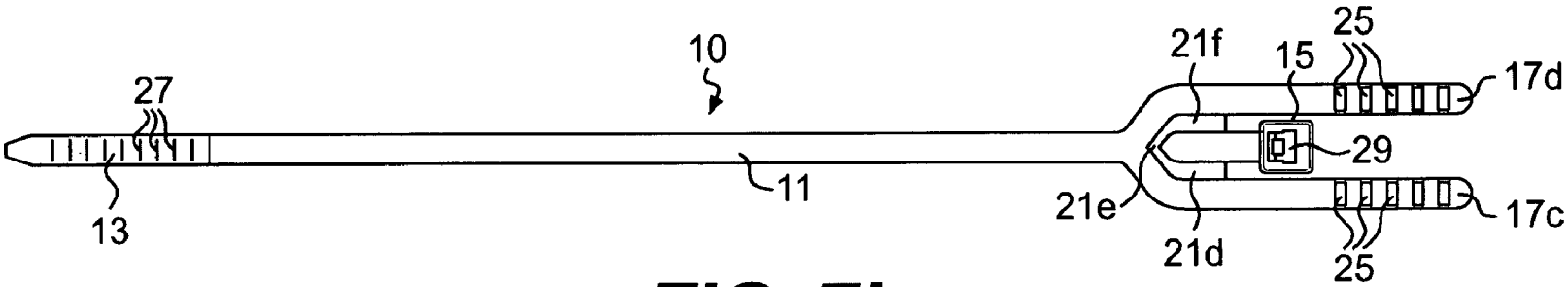
FIG. 7*b* shows a side view of another version of the invention having a two tear tabs side by side.

FIG. 7*b* illustrates the use of two parallel tear tabs going in the same direction. The web is comprised of an inline section 21*d* and a V-shaped section 21*e* connected to an inline section 21*f* opposite inline section 21*d* and going in the same direction. Pull tabs 17*c* and 17*d* distribute tensile forces along web extensions 21*d* and 21*f* respectively. Aesthetically, the symmetrical appearance may be more attractive. Also, for some size ties, the ends of tabs 17*c* and 17*d* could be grasped by the thumb and forefinger of one hand and the tie separated by pulling in one direction along the strap. Note that, as in the previous figure, the web extensions 21*d* and 21*f* do not connect to the enclosure 15, although they could. Unlike the version in FIG. 7*a*, a pull tab is required for each inline web section; it is not possible to use only one pull tab and reverse direction to finish tearing the web.

The disadvantage of both of the last two versions is that they add slightly to the material and volume of the ties. Since tote box retainers are sold in the 100s of millions, even a fractional increase in cost or volume may be undesirable.

Additional Variations of the Invention:

This invention is not limited to the foregoing versions, but encompasses additional ones. The following are illustrative, but not exhaustive.

First, cable ties are generally flat straps, but this is not necessary. A square, round or other cross-section strap could be used as long as the channels 19 and 39 were deep enough to form the web 21.

Second, the illustrated enclosure 15 is fairly typical of those in widespread use. However, this strap retaining structure could be of any shape and use any method to grip an inserted strap. For example, some designs use a metal pawl.

Third, it is not necessary to have the teeth 35 as illustrated. With a suitable retaining mechanism, they could be located on both top and bottom or on the sides. Round straps might use a series of bulges with a suitable retaining mechanism.

Fourth, the pull tabs 17 need not have the rib finger grips 25 or 41 or could have a single rib on the end. Also, the pull tabs 17 need not be a rectangular strap, but could extend to the side of the cable tie 10 to form a larger area. This area need only be sufficient to allow gripping with a thumb and forefinger. However, a larger area is less desirable than using finger grips, because it would require extra material and increases the tie packaging size.

Fifth, the web 21 need not be of uniform thickness. Moreover, the web could be perforated as is commonly done with paper. One of the channels 19 or 39 forming the web 21 could be eliminated.

Sixth, one of the distinguishing features of the invention is the direction that an imaginary centerline running down the center of the web, approximately coincident with the tear line, makes along the web. In FIGS. 1*a*–1*c*, 3*a* & 3*b*, 4*a* & 4*b*, & 6, web 23 has a section that is generally inline with the strap 11 and a section that transverses the strap at an angle of about 135° to the inline section. In FIG. 7*a*, the transverse section 21*b* also makes an approximately 135° angle to inline sections 21*a* and 21*c*. The angle between these sections is illustrated as being about 135°, but it could be less or more, conceivably as little as 90° or approaching 180°. However, angles approaching 180° would use up most of the strap. Angles of 90° would require an abrupt change in tearing motion direction and reduce the leverage to finish tearing through the end of the web. The 135° angle optimizes having an ergonometric tearing motion without using up too much of the strap.

The easy tearing motion can also be described by noting that the direction of the centerline does not change by much. In FIGS. 1*a*–1*c*, 3*a* & 3*b*, 4*a* & 4*b*, 6, & 7*a*, the centerline in the web 21 does not rotate by more than about 45°. Somewhat arbitrarily, the centerline should not rotate more than about 60° for optimum performance. This means that the transverse section of the web has an angle of at least 30° from a line across the strap. In FIG. 7*b*, the same is true for each of the symmetrical halves. With this limitation, the web will not double back on itself to form a serpentine or U-shaped web with two transverse sections connected by an inline section, as this is inconvenient to pull apart.

What is critical and what, in part distinguishes this invention from other attempts to provide hand removable cable ties is the use of reinforcing sections on the ends of the web 21. Simply terminating the web at the edge of the strap without reinforcement would leave a notch that could start a tear under lighter than needed tensile stresses. As explained above, reinforcement may be accomplished in two ways. First, an end of the web may be terminated in a thick section 23 as illustrated in FIGS. 1*a*–1*c*. Second, an inline web extension can be added and reinforced with a tab as in FIG. 7. There may be other ways to add reinforcement and these are not excluded.

In summary, following the teachings of this invention, it is possible to make a tote box retainer that minimizes the manual separation effort for a given overall tensile strength. Other variations will be apparent to those skilled in this art without departing from the invention as claimed below.

What is claimed is:

1. A hand removable tie for temporally securing a tote box lid to a tote box comprising:

a) a strap having a multiplicity of teeth over a substantial portion and terminated in one end with an enclosure containing a tooth engaging pawl and on the other with a tip that can be inserted into said enclosure and pulled through to have said teeth engage said pawl in a reverse pull-out resistant manner, further comprising:

b) a pull tab that extends from said strap to one side of said strap adjacent to said enclosure, there being a channel of reduced thickness material disposed between said pull tab and said strap and continuing across said strap toward the edge of said strap opposite said pull tab but leaving a thick section in said strap at said opposite edge, whereby said tie has adequate strength to hold a tote box lid in place, but a human hand can pull on said pull tab and readily separate said strap into two pieces.

2. The tie of claim 1 wherein the centerline in said channel does not rotate more than about 60 degrees from one end of said channel to the other.

3. The tie of claim 1 wherein said pull tab has finger grips.

4. The tie of claim 1 wherein said strap has a stop.

5. A hand separable tie having a strap with a separation structure, said separation structure comprising:

a web having a section generally transverse to and extending across said strap and terminated with a first reinforcement section comprising an extended inline web section;

a pull tab extending from said strap adjacent to said first extended web section; and a second reinforcement section comprising an inline web section connected to said transverse section opposite said pull tab and extending along the side of said strap and having a reinforcing tab attached to said second reinforcement section.

6. The tie of claim 5 wherein the centerline in said web sections does not rotate more than about 60 degrees from one end of said web to the other.

7. The tie of claim 6 wherein said strap has a plurality of teeth disposed along said strap and a retaining structure having a pawl that engages said teeth in a non-releasable manner.

8. A hand separable tie having a strap with a separation structure, said separation structure comprising:

a web having a first section generally inline with said strap along one edge, a second generally inline section along an opposite edge of said strap, a V-shaped section connecting said first inline section with said second inline section;

a first pull tab extending from said strap and joined to the edge of said first inline web section opposite said strap; and a second pull tab extending from said strap and joined to the edge of said second inline web section opposite said strap.

9. The tie of claim 8 wherein the centerline in said web sections does not rotate more than about 60 degrees from one end of said web to the vertex of said V-shaped section.

10. The tie of claim 8 wherein said pull tab has finger grips.

11. The tie of claim 8 wherein said strap has a plurality of teeth disposed along said strap and a retaining structure having a pawl that engages said teeth in a non-releasable manner.

* * * * *

UNITED STATES PATENT AND TRADEMARK OFFICE

CERTIFICATE OF CORRECTION

PATENT NO. : 7,062,820 B1
APPLICATION NO. : 10/861322
DATED : June 20, 2006
INVENTOR(S) : Robert L. Oestreich et al.

It is certified that error appears in the above-identified patent and that said Letters Patent is hereby corrected as shown below:

On the title page, item [73] the assingee should read:

Assignee: Bay State Cable Ties, LLC, Clearview, FL (US)

Signed and Sealed this

Twenty-seventh Day of March, 2007

JON W. DUDAS
*Director of the United States Patent and Trademark Office*